US007321739B1

(12) United States Patent
Dawson et al.

(10) Patent No.: US 7,321,739 B1
(45) Date of Patent: Jan. 22, 2008

(54) CARTRIDGE WITH A HANDLE FOR USE WITH AN IMAGE FORMING DEVICE

(75) Inventors: Jedediah Taylor Dawson, Lexington, KY (US); Paul Douglas Horrall, Lexington, KY (US); Matthew Thomas Kerley, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/741,977

(22) Filed: Apr. 30, 2007

(51) Int. Cl.
*G03G 15/08* (2006.01)

(52) U.S. Cl. ..... 399/90; 399/262; 347/86; 222/DIG. 1

(58) Field of Classification Search ..... 399/12, 399/13, 25, 27, 28, 37, 88, 90, 111, 119, 120, 399/262; 347/50, 86, 87, 214; 222/323, 222/465.1, DIG. 1; 439/247, 248; 346/140.1
See application file for complete search history.

(56) References Cited

U.S. PATENT DOCUMENTS

| | | | | |
|---|---|---|---|---|
| 4,017,005 | A | 4/1977 | Forbes, Jr. | |
| 4,544,260 | A * | 10/1985 | Kolbe | 399/111 |
| 4,583,832 | A | 4/1986 | Kasamura et al. | |
| 4,839,691 | A | 6/1989 | Tagawa et al. | |
| 5,204,713 | A * | 4/1993 | Yamamura | 399/119 |
| 5,365,315 | A * | 11/1994 | Baker et al. | 399/111 |
| 5,812,910 | A | 9/1998 | Kim | |
| 5,819,139 | A * | 10/1998 | Harlan et al. | 399/110 |
| 5,906,143 | A * | 5/1999 | Yuen | 81/3.39 |
| 6,167,223 | A * | 12/2000 | Fiore et al. | 399/165 |
| 6,168,262 | B1 | 1/2001 | Clark et al. | |
| 6,364,458 | B2 * | 4/2002 | Eckard et al. | 347/49 |

(Continued)

FOREIGN PATENT DOCUMENTS

EP 1344650 A1 * 9/2003

(Continued)

OTHER PUBLICATIONS

"Samsung Black Toner Cartridge for CLP-300 and CLP300N." Super Warehouse. Apr. 20, 2007, 2 pages, http://www.superwarehouse.com/Samsung_Black_Ink_Cartridge_for_CLP-300_and_CLP-300N/CLP-K30....

*Primary Examiner*—Robert Beatty
(74) *Attorney, Agent, or Firm*—Coats & Bennett, P.L.L.C.

(57) ABSTRACT

The present application is directed to cartridges for use in image forming devices. In one embodiment, the toner cartridge includes a body with an enclosed interior to contain toner. An electrical connector with one or more electrical contacts may be positioned on a first side of the body. A handle may be mounted to a second side of the body opposite from the first side. The handle may be movable between an open orientation that extends outward from the body and a closed orientation positioned in proximity to the body. A biasing member may be operatively connected to the handle to force the handle towards the open orientation. When the cartridge is mounted in the image forming device, a lid on the image forming device may be closed which moves the handle to the closed orientation. In this orientation, the biasing member may exert a force directed towards the second side. In one embodiment, this force maintains the electrical connector engaged with a corresponding receptacle in the image forming device.

10 Claims, 17 Drawing Sheets

U.S. PATENT DOCUMENTS

| | | | | |
|---|---|---|---|---|
| 6,406,202 | B1 * | 6/2002 | Unno et al. | 400/613 |
| 6,431,697 | B1 * | 8/2002 | King et al. | 347/86 |
| 6,470,159 | B2 | 10/2002 | Dycher | |
| 6,647,226 | B2 | 11/2003 | Katakabe et al. | |
| 7,139,510 | B2 * | 11/2006 | Carter et al. | 399/113 |
| 2005/0275700 | A1 * | 12/2005 | Buchanan et al. | 347/86 |
| 2007/0071481 | A1 * | 3/2007 | Kamimura | 399/90 |
| 2007/0147887 | A1 * | 6/2007 | Hattori | 399/119 |

FOREIGN PATENT DOCUMENTS

| | | | | |
|---|---|---|---|---|
| JP | 60179753 | A | * | 9/1985 |
| JP | 61295046 | A | * | 12/1986 |
| JP | 02300769 | A | * | 12/1990 |
| JP | 2005138338 | A | * | 6/2005 |
| JP | 2004084132 | | | 10/2005 |

* cited by examiner

CARTRIDGE WITH A HANDLE FOR USE WITH AN IMAGE FORMING DEVICE

BACKGROUND

The present application is directed to a cartridge for use with an image forming device and, more particularly, to a cartridge with a handle movable between open and closed orientations for mounting the cartridge within the image forming device.

Image forming devices use toner for producing images on a media sheet. The toner may be housed within a cartridge that is removable from the image forming device. Removal and installation of the cartridges may occur during initial start-up of the device, when the toner has been depleted from the cartridge, and miscellaneous other occurrences.

The cartridges include a body with an interior reservoir for containing the toner. The cartridge may include a variety of elements that are exposed on the exterior of the body, such as a photoconductive drum for laser image forming devices, a shutter for moving the toner from the reservoir, and projections sized and positioned for installing the cartridge into the body. The cartridge may be difficult to handle and manipulate by the user during installation and removal from the device. The user should be careful to prevent from contacting the cartridge in a manner that could damage the delicate elements on the exterior. Further, the user should be careful during removal to prevent getting toner on their fingers and hands. Handling of the cartridge is further complicated because the cartridge may mount within the image forming device in various locations.

The cartridge should further be constructed to prevent toner leakage from the interior reservoir. Toner leaks may result in print defects, and toner inadvertently contacting the user or the user workstation. The cartridge should also be constructed to work properly to form quality images, yet not be constructed in a manner that greatly increases the overall cost of the cartridge. Cost may be a major factor in the purchasing decisions of consumers when selecting a cartridge.

SUMMARY

The present application is directed to cartridges for use in image forming devices. In one embodiment, the toner cartridge includes a body with an enclosed interior to contain toner. An electrical connector with one or more electrical contacts may be positioned on a first side of the body. A handle may be mounted to a second side of the body opposite from the first side. The handle may be movable between an open orientation that extends outward from the body and a closed orientation positioned in proximity to the body. A biasing member may be operatively connected to the handle to force the handle towards the open orientation. When the cartridge is mounted in the image forming device, a lid on the image forming device may be closed which moves the handle to the closed orientation. In this orientation, the biasing member may exert a force directed towards the second side. In one embodiment, this force maintains the electrical connector engaged with a corresponding receptacle in the image forming device.

DETAILED DESCRIPTION

Figure 1A:
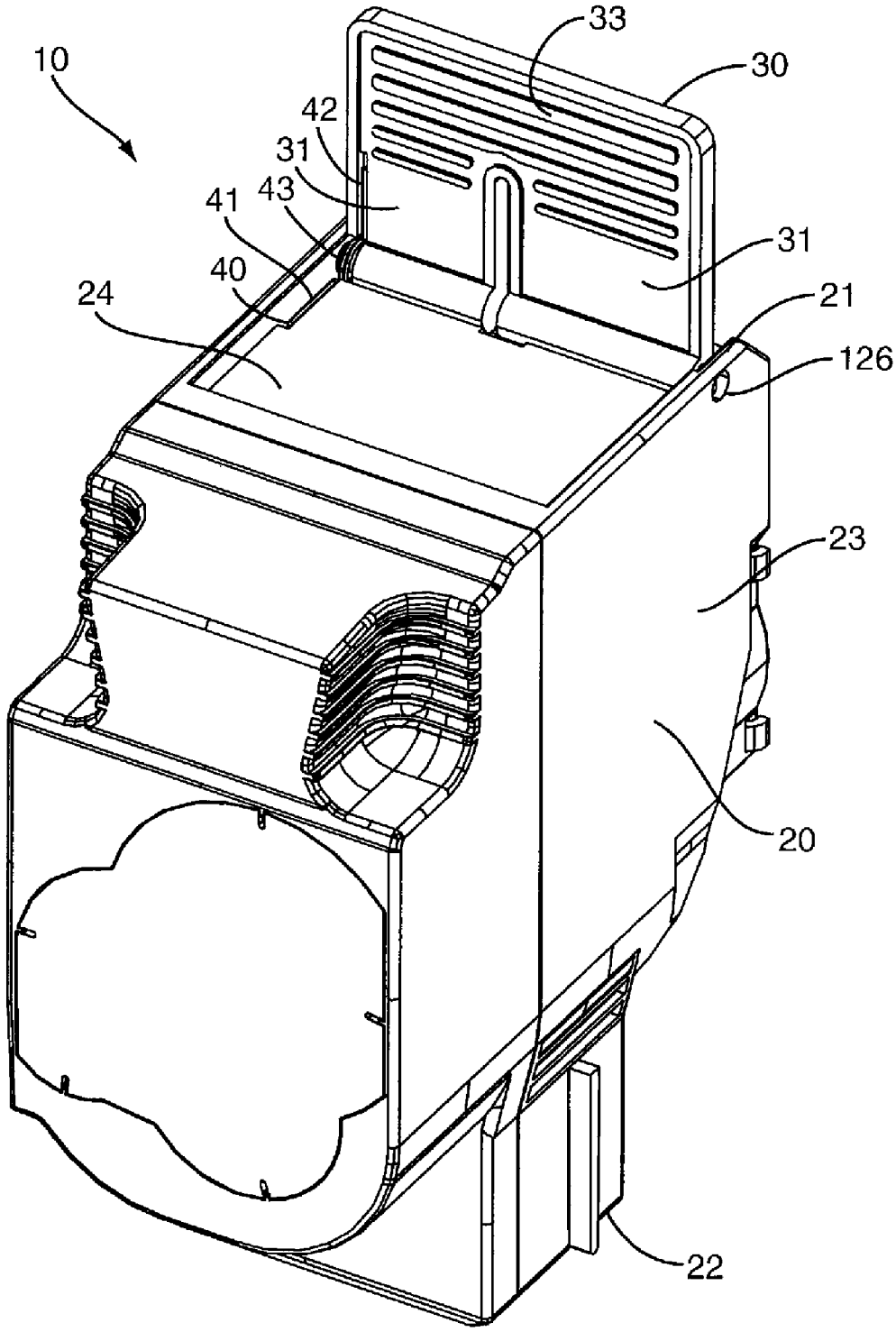
FIG. 1A is a front perspective view of a cartridge with a handle in an open orientation according to one embodiment.
Figure 1B:
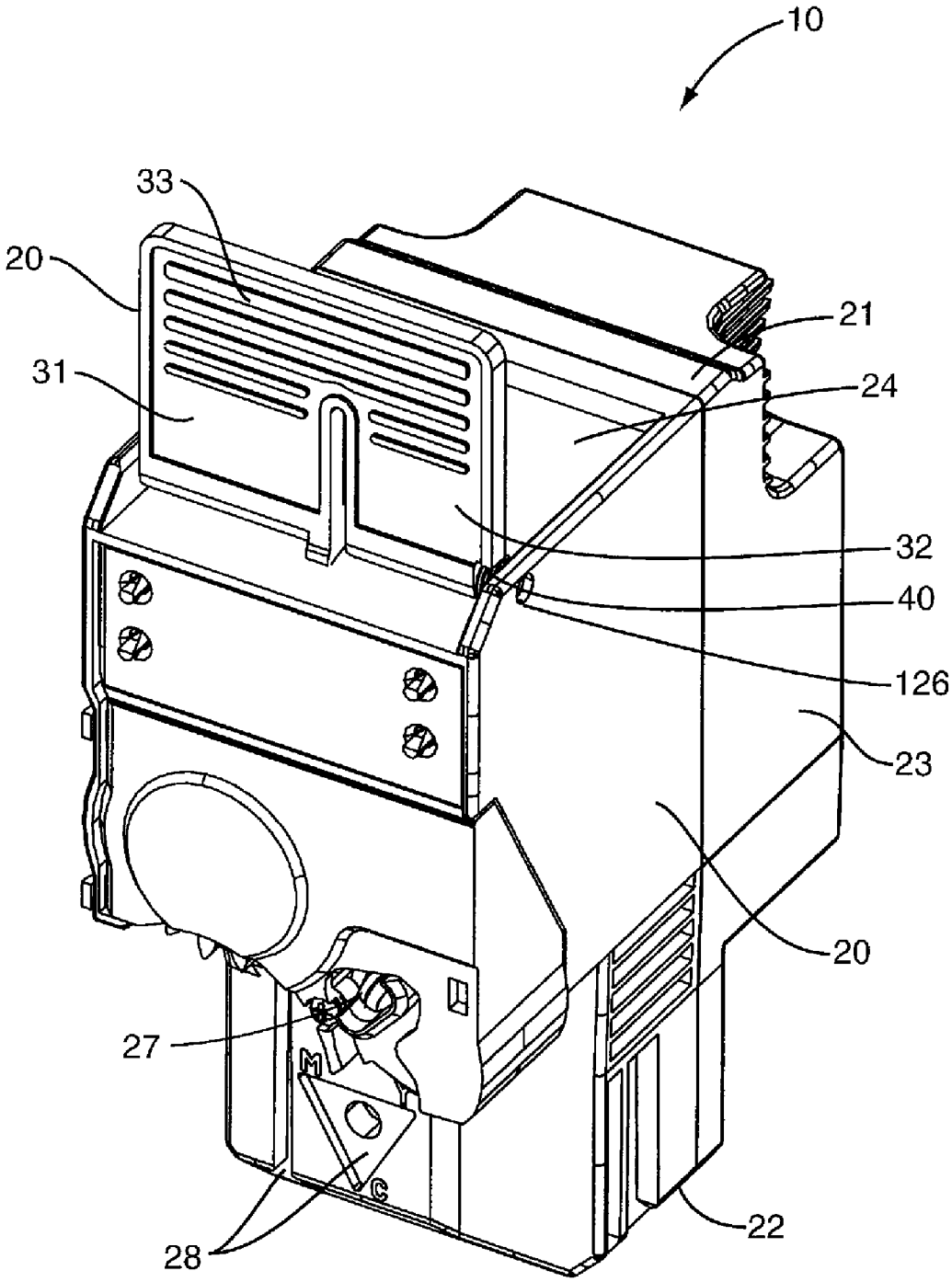
FIG. 1B is a back perspective view of a cartridge with a handle in an open orientation according to one embodiment.
Figure 2:
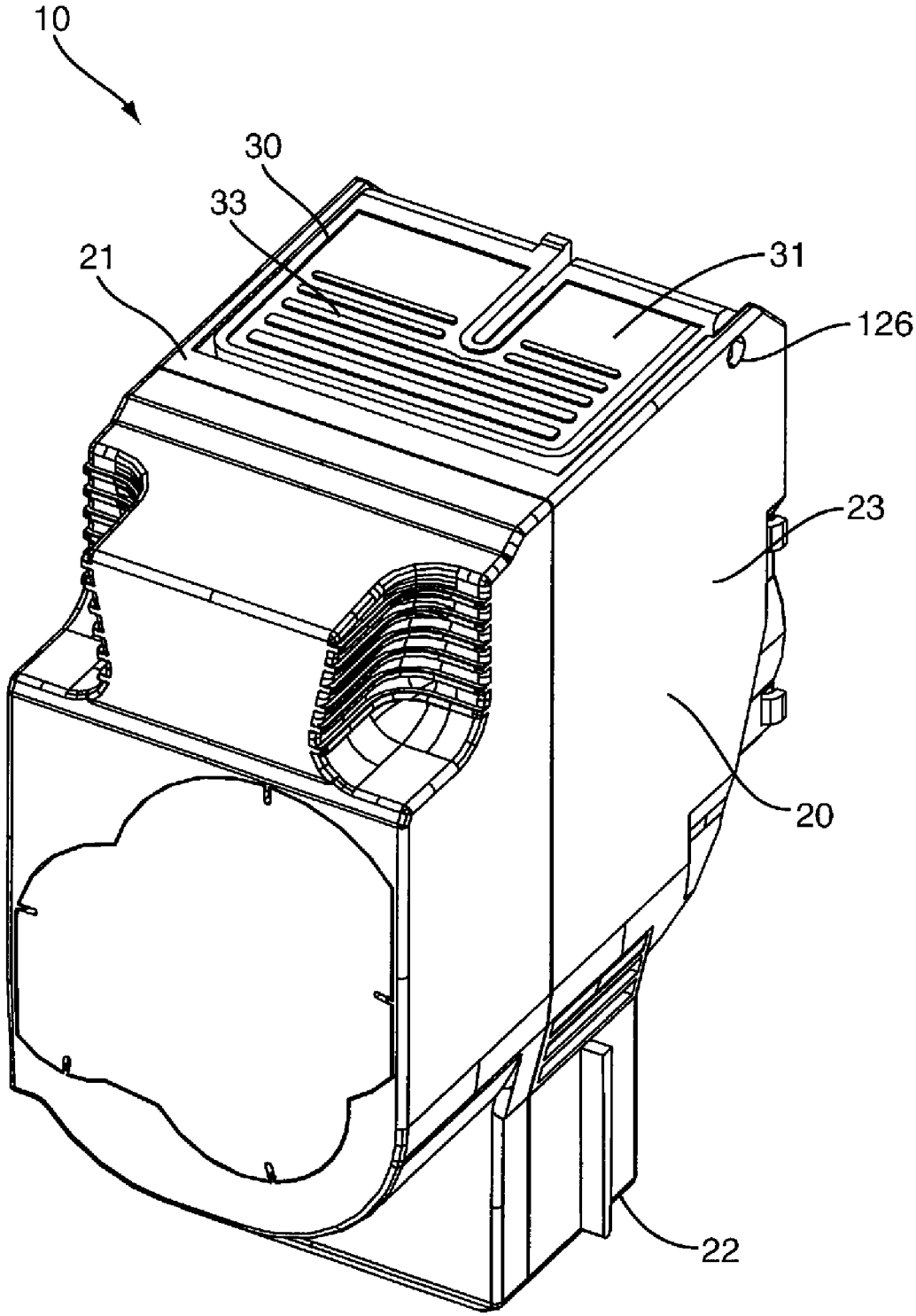
FIG. 2 is a front perspective view of a cartridge with a handle in a closed orientation according to one embodiment.

The present application is directed to toner cartridges with a movable handle for use with an image forming device. FIGS. 1A, 1B, and 2 illustrate one embodiment of a cartridge 10. Cartridge 10 includes a body 20 with an enclosed interior reservoir to contain toner. A handle 30 is mounted on the exterior of the body 20 and movable between an open orientation as illustrated in FIGS. 1A and 1B, and a closed orientation as illustrated in FIG. 2. A biasing mechanism 40 biases the handle 30 towards the open orientation. Biasing mechanism 40 further provides a downward force to the body 20 when the handle 30 is in the closed orientation to maintain the cartridge 10 engaged within the image forming device.

Body 20 includes a top side 21, bottom side 22, and lateral sides 23. As illustrated in FIGS. 1A and 1B, an indentation 24 may be formed on the top side 21 to receive the handle 30 in the closed orientation. In one embodiment, indentation 24 includes a depth such that the handle 30 is positioned below the top side 21 in the closed orientation. In another embodiment, the depth of the indentation 24 is insufficient for the handle 30 to be completely below the top side 21 in the closed orientation. As illustrated in FIG. 1B, one or more mating features 28 are located for positioning the cartridge 10 within the image forming device 100. Mating features 28 may include slots, protrusions, and shapes that allow the cartridge 10 to be mounted within a specific location in the image forming device, but prevent mounting in other locations. In one embodiment, mating features 28 are positioned on the lateral sides 23 of the body 20 in proximity to the bottom side 22.

Figure 4:
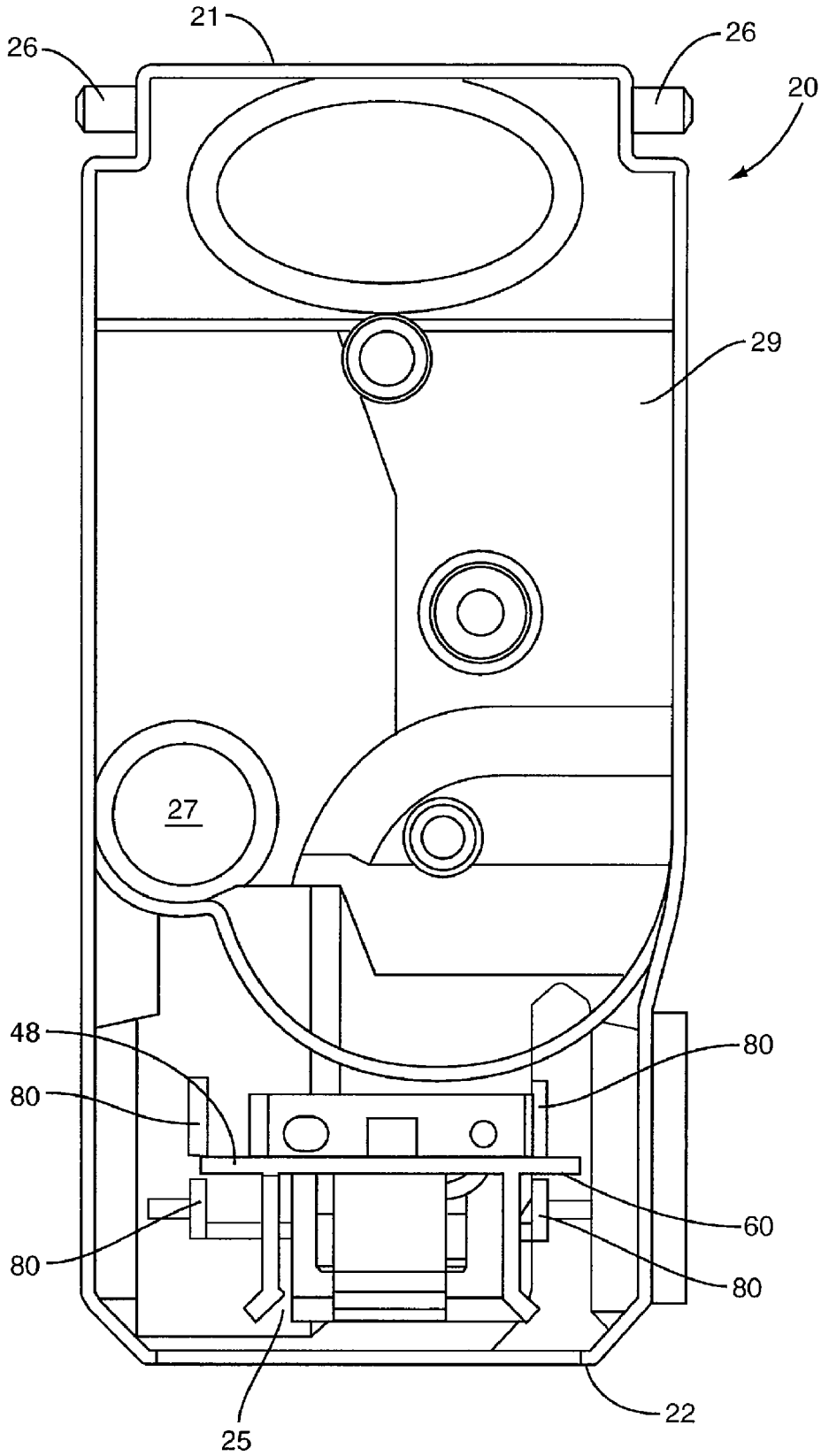
FIG. 4 is a side cut-away view of a cartridge according to one embodiment.

Cartridge 10 also includes an electrical connector 60 as illustrated in FIG. 4. In one embodiment, the electrical connector 60 is mounted towards the bottom side 22 of the body 20 below the toner reservoir 29. Connector 60 may be positioned within a cavity 25 that extends inward from the bottom side 22. Cavity 25 may be sized to entirely contain the electrical connector 60 as illustrated in FIG. 4, or partially contain the electrical connector 60 with a lower edge of the connector 60 extending outward beyond the bottom side 22 of the body 20.

Figure 5:
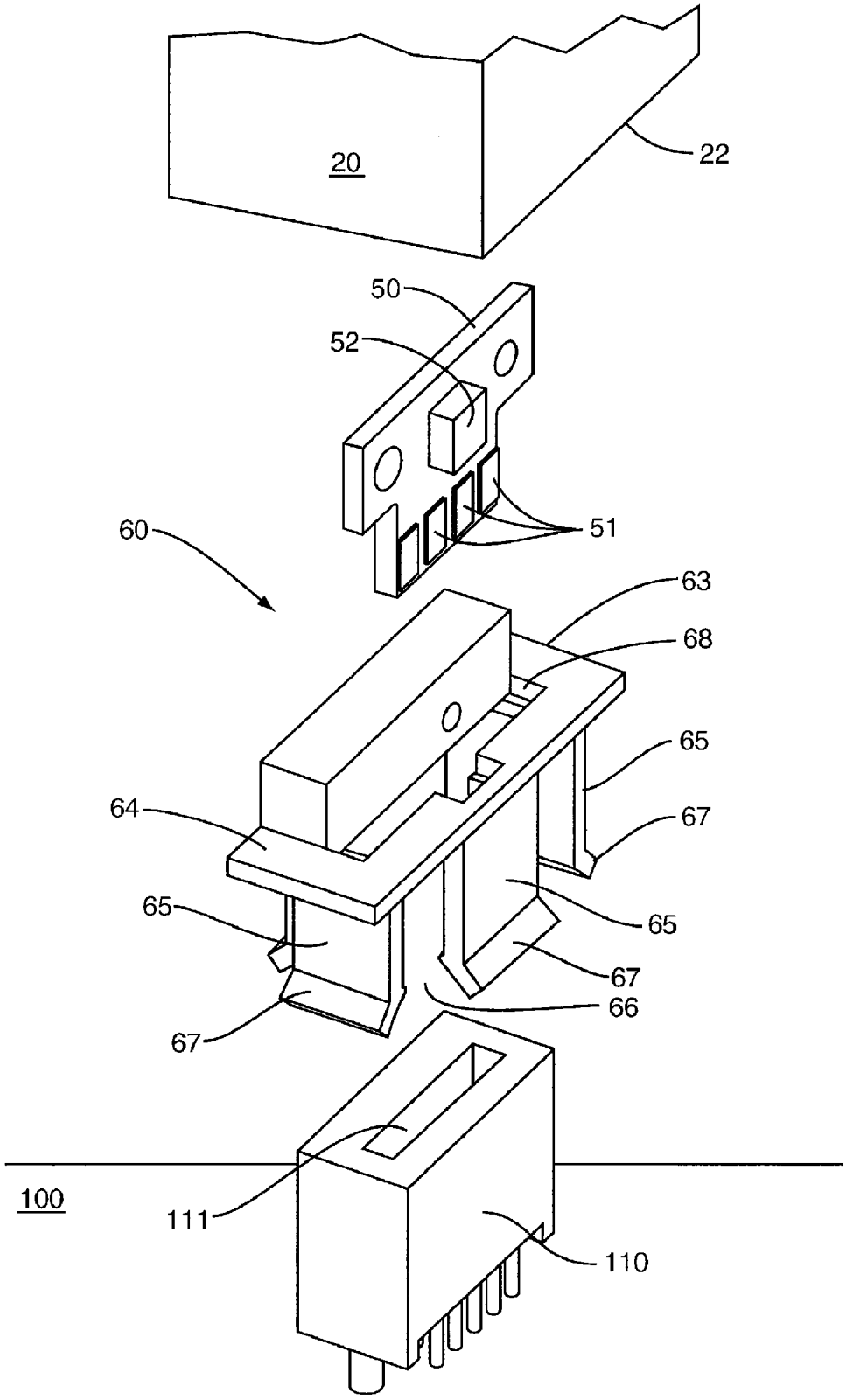
FIG. 5 is an exploded view of an electrical connector and a corresponding connector within an image forming device according to one embodiment.

FIG. 5 illustrates an exploded view of the electrical connector 60 and the corresponding connector 110 in the image forming device 100. Connector 60 includes a circuit board 50 and a housing 63. The circuit board 50 includes one or more electrical contacts 51. In one embodiment as illustrated in FIG. 5, the electrical contacts 51 are positioned at a bottom side of the circuit board 50. Circuit board 50 may further include computing hardware, schematically illustrated as 52, for storing cartridge parameters including but not limited to pages printed, toner color, first use date, and cartridge ID. The computing hardware 52 may include one or more processors, logic devices, and memory. The computing hardware 52 may further comprise integrated circuits, including for example application specific integrated circuits and digital signal processors, in which embedded program code may be stored and executed.

Housing 63 is constructed to position the circuit board 50 for engaging with the connector 110 within the image forming device 100. Housing 63 includes a base 64 with one or more outwardly-extending arms 65. Arms 65 may be rigid or may be flexible relative to the base 64. In one embodiment, four arms extend from the base 64 and each is flexible. In another embodiment, multiple arms 65 extend from the base 64 with some one or more of the arms 65 being flexible and the others being rigid. The arms 65 form a receptacle 66 sized to extend around the entirety or a portion of the connector 110. One or more of the arms 65 may further include a flared end 67 to facilitate engagement with the connector 110 of the image forming device 100. In one embodiment, the inner edges of the arms 65 are substantially smooth to facilitate sliding contact during engagement with the connector 110. Base 64 further includes an opening 68 sized to receive the circuit board 50 and position it within the receptacle 66.

Figure 6B:
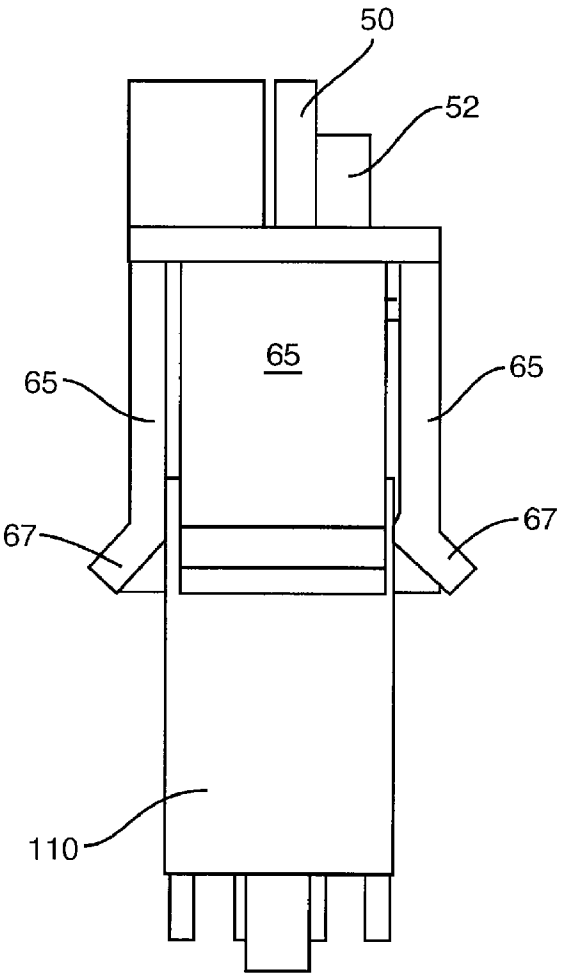
FIG. 6B is a side view of an electrical connector being mounted to a corresponding connector according to one embodiment.
Figure 6A:
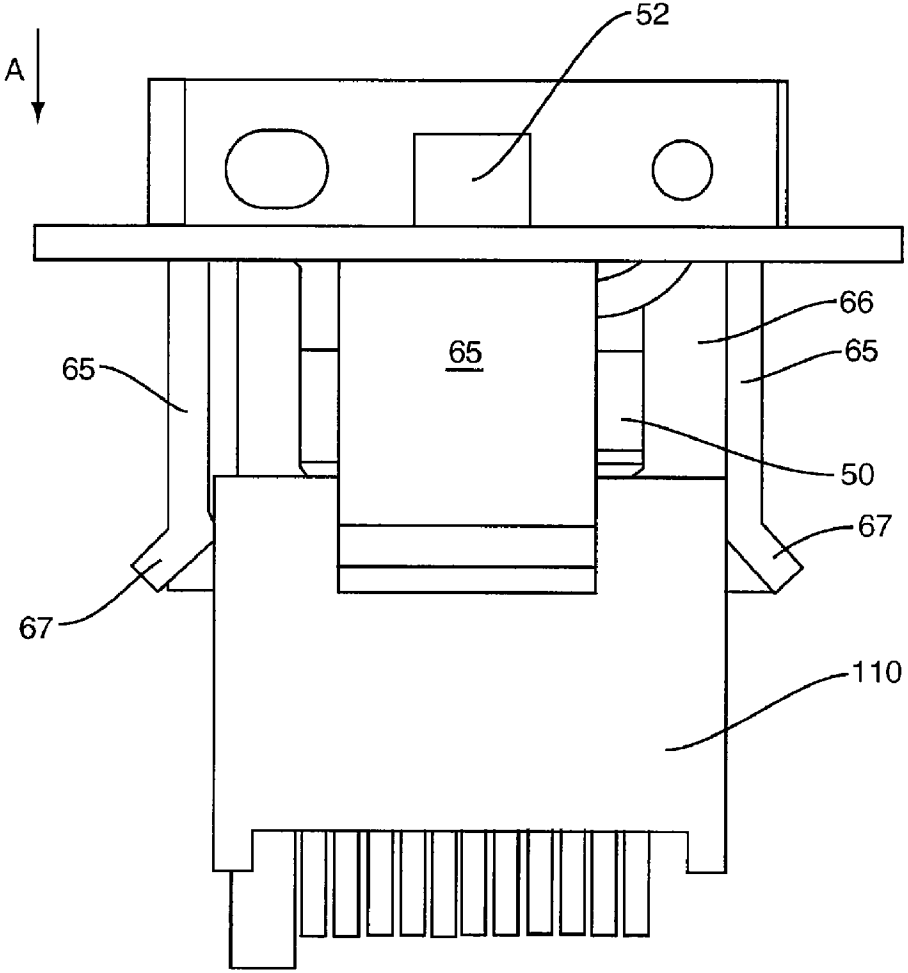
FIG. 6A is a front view of an electrical connector being mounted to a corresponding connector according to one embodiment.
Figure 7:
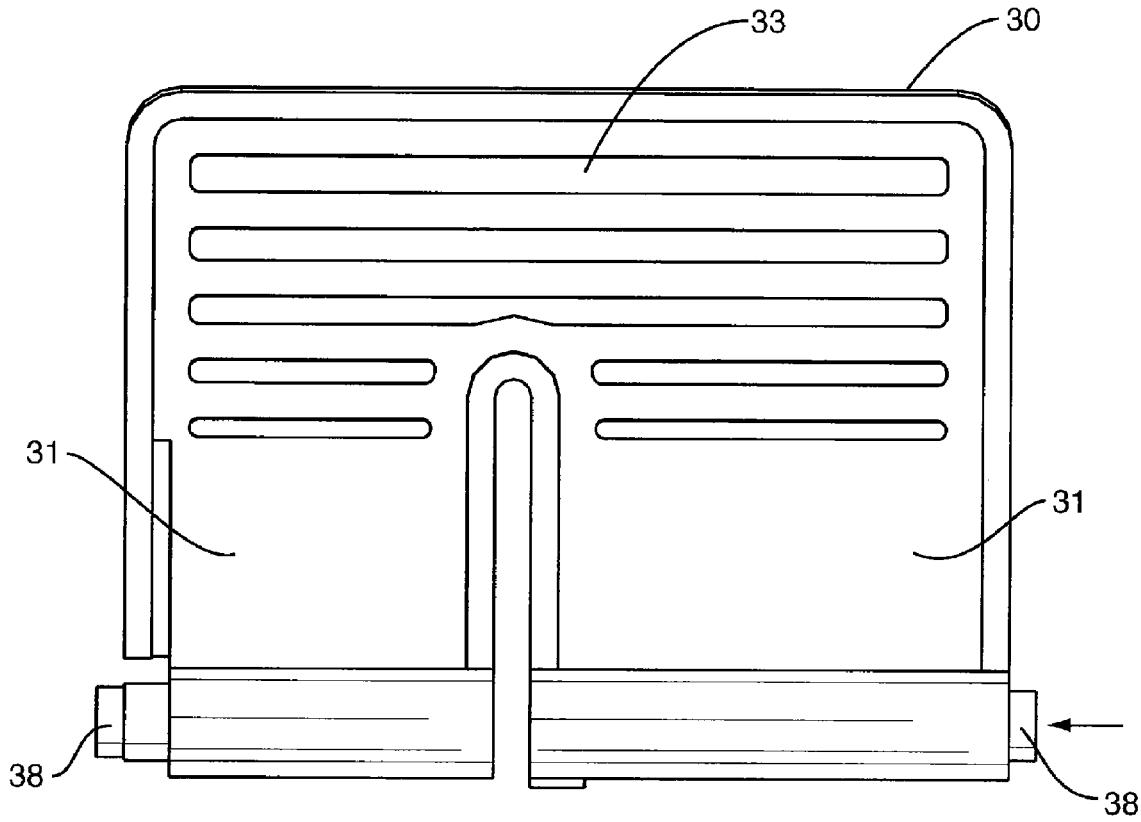
FIG. 7 is a side view of a handle according to one embodiment.

FIGS. 6A and 6B illustrate the electrical connector 60 partially engaged with the connector 110. The receptacle 66 formed by the arms 65 is sized to receive the connector 110. In this embodiment, the inner sides of the arms 65 are substantially smooth to facilitate sliding movement of the arms 65 along the outer edges of the connector 110. The arms 65 act as a guide to position the circuit board 50 relative to the connector 110. With the arms 65 in contact with the connector 110, the circuit board 50 is guided into the opening 111 in the connector 110. The electrical contacts 51 contact corresponding contacts in the opening 111 to form the communication path between the cartridge 10 and the device 100. Embodiments of electrical connectors are disclosed in U.S. patent application Publication Ser. Nos. 11/554,157 and 11/554,117 each incorporated by reference herein in their entireties.

Figure 3:
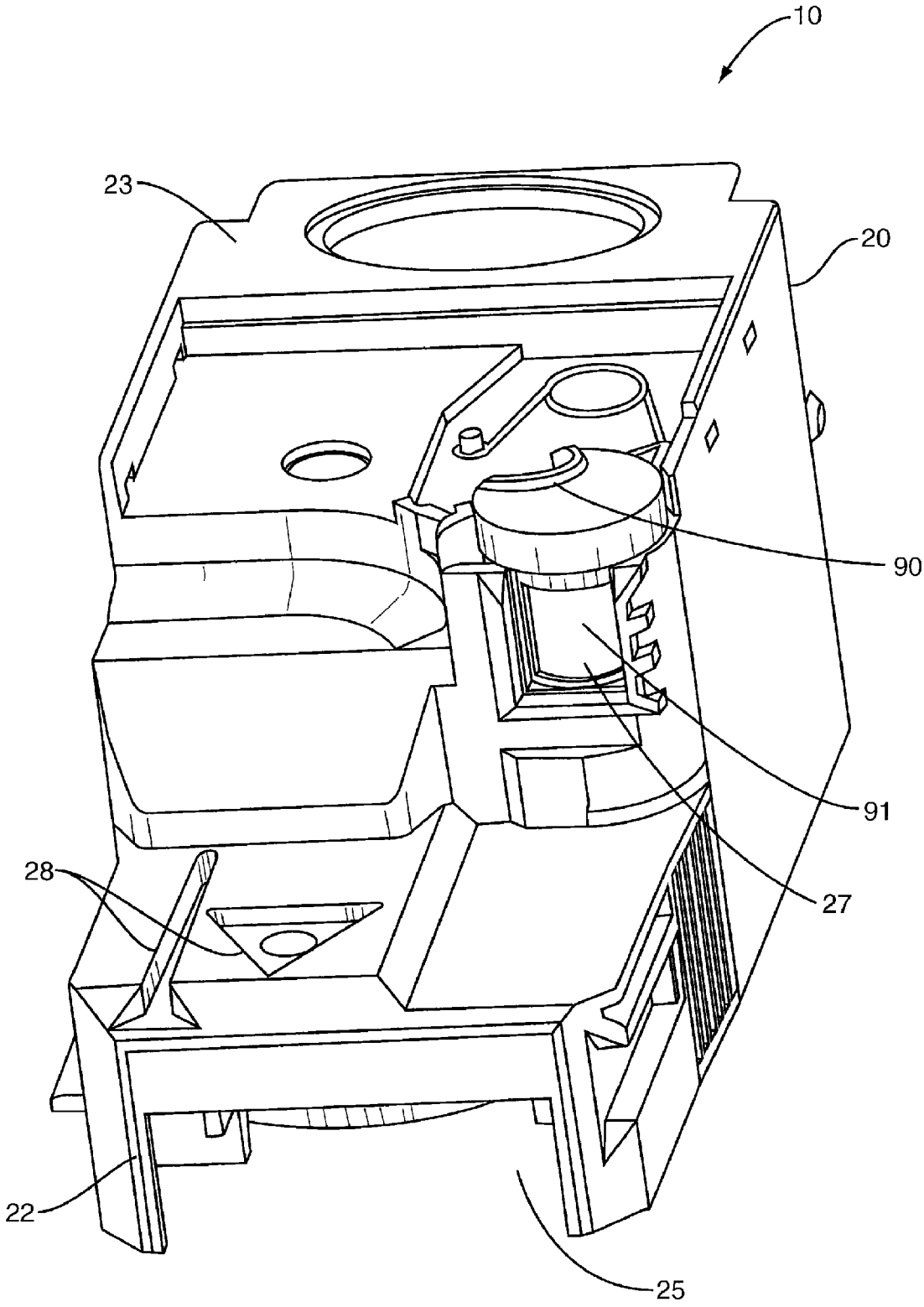
FIG. 3 is a perspective view of a bottom of a cartridge according to one embodiment.

As illustrated in FIGS. 1B, 3 and 4, body 20 further includes an outlet 27 for moving the toner from the enclosed interior reservoir 29 into the image forming device 100. In one embodiment, outlet 27 is positioned on a lateral side 23 between the top and bottom sides 21, 22. A shutter 90 that includes an aperture 91 is movably positioned within the outlet 27. Shutter 90 is movable between a closed orientation with the aperture 91 moved away from the outlet 27 to prevent toner movement, and an open orientation with the aperture 91 aligned with the outlet 27 to move toner from the reservoir and into the image forming device 100.

Handle 30 is movably mounted to the body 20 and provides a means for a user to grasp and manipulate the cartridge 10. In one embodiment as illustrated in FIGS. 1A, 1B, 2, and 7, handle 30 includes a pair of spaced-apart arms 31 and a grip member 33. Feet 38 that face outward may be positioned at the ends of each arm 31. The arms 31 may be compressed together to attach the handle 30 to the body 20. Once compressed, the feet 38 may be aligned with openings 126 in the body 20. Once the arms 31 are released, the feet 38 move into the openings 126 to attach the handle to the body 20.

Figure 8:
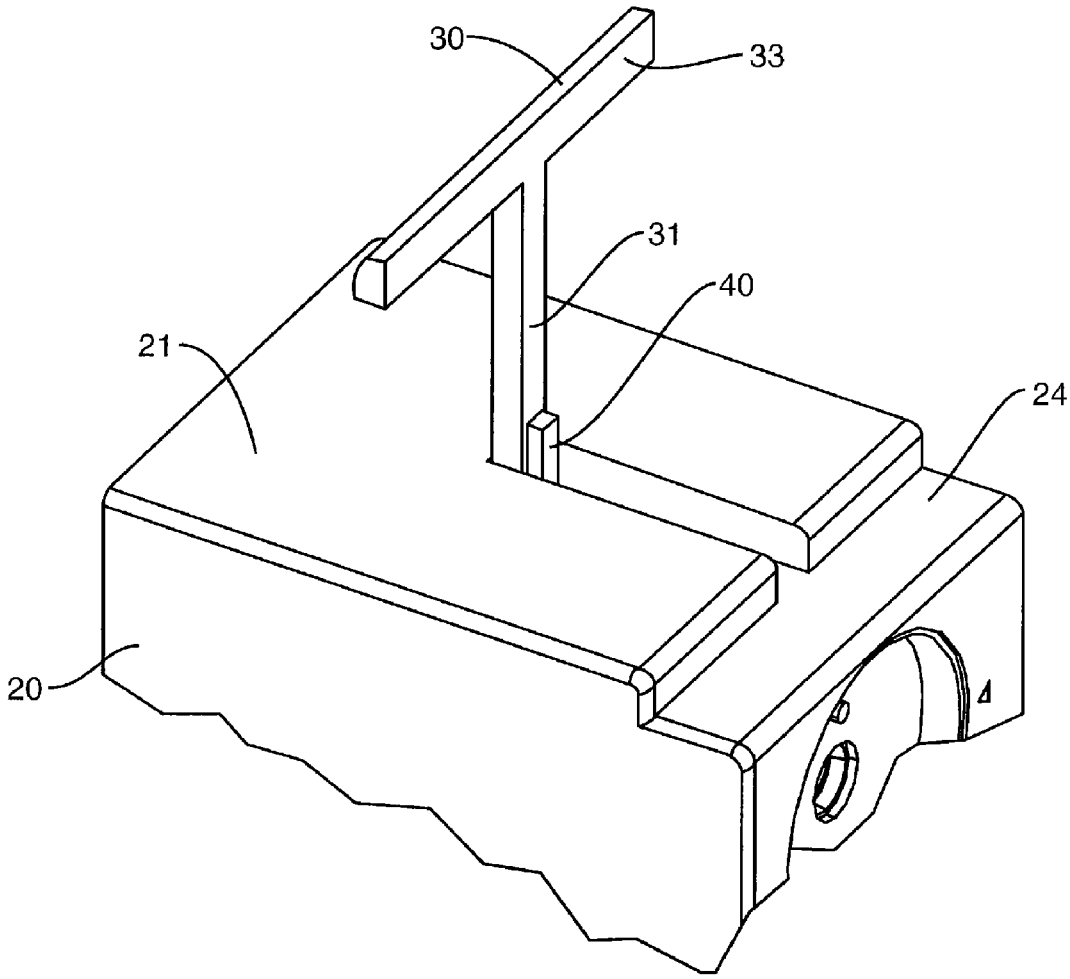
FIG. 8 is a perspective view of a cartridge with a handle in an open orientation according to one embodiment.
Figure 9A:
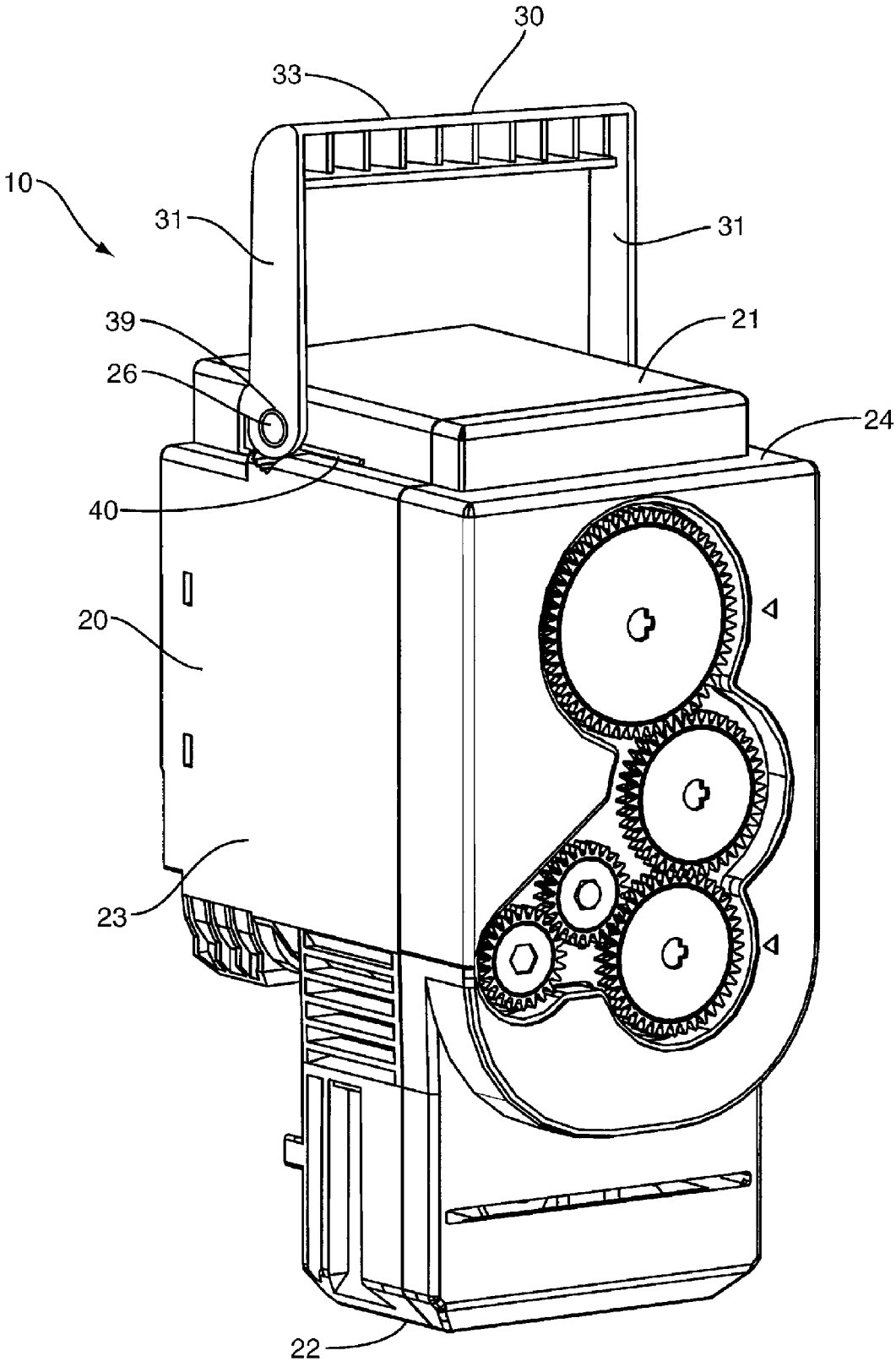
FIG. 9A is a perspective view of a cartridge with a handle in an open orientation according to one embodiment.
Figure 9B:
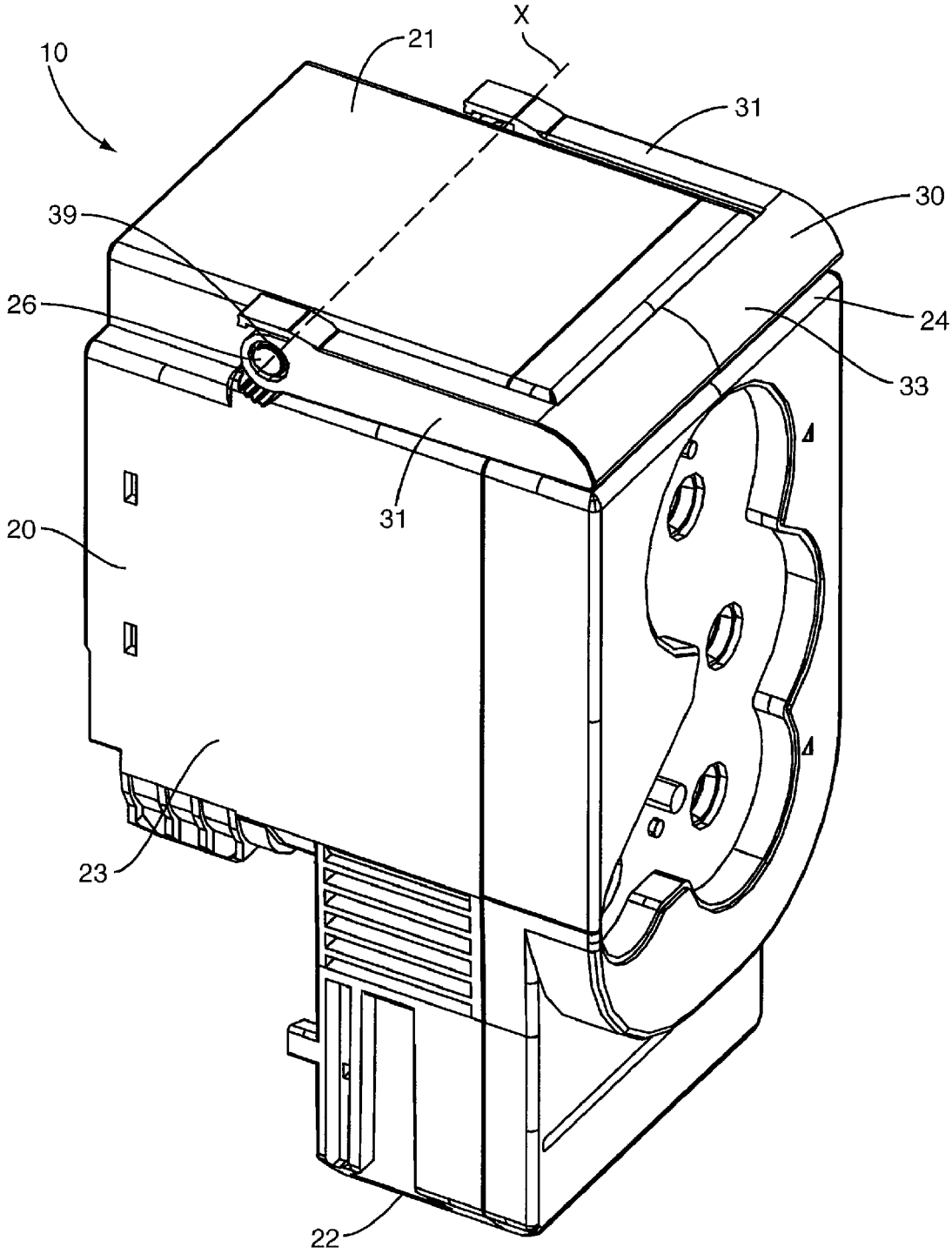
FIG. 9B is a perspective view of a cartridge with a handle in an open orientation according to one embodiment.

FIG. 8 illustrates another embodiment with the handle 30 including a substantially T-shape with a single arm 31 and a grip member 33. Handle 30 may also include various other shapes and sizes depending upon the context of use. FIGS. 9A and 9B illustrate another embodiment of the handle 30 including a substantially C-shape with a pair of arms 31 and a grip member 33 extending therebetween.

In one embodiment, handle 30 is mounted on one or more projections 26 that extend outward from the body 20. In the embodiment of FIGS. 9A and 9B, each arm 31 includes an aperture 39 that each fits over a corresponding projection 26 to attach the handle 30.

Figure 10:
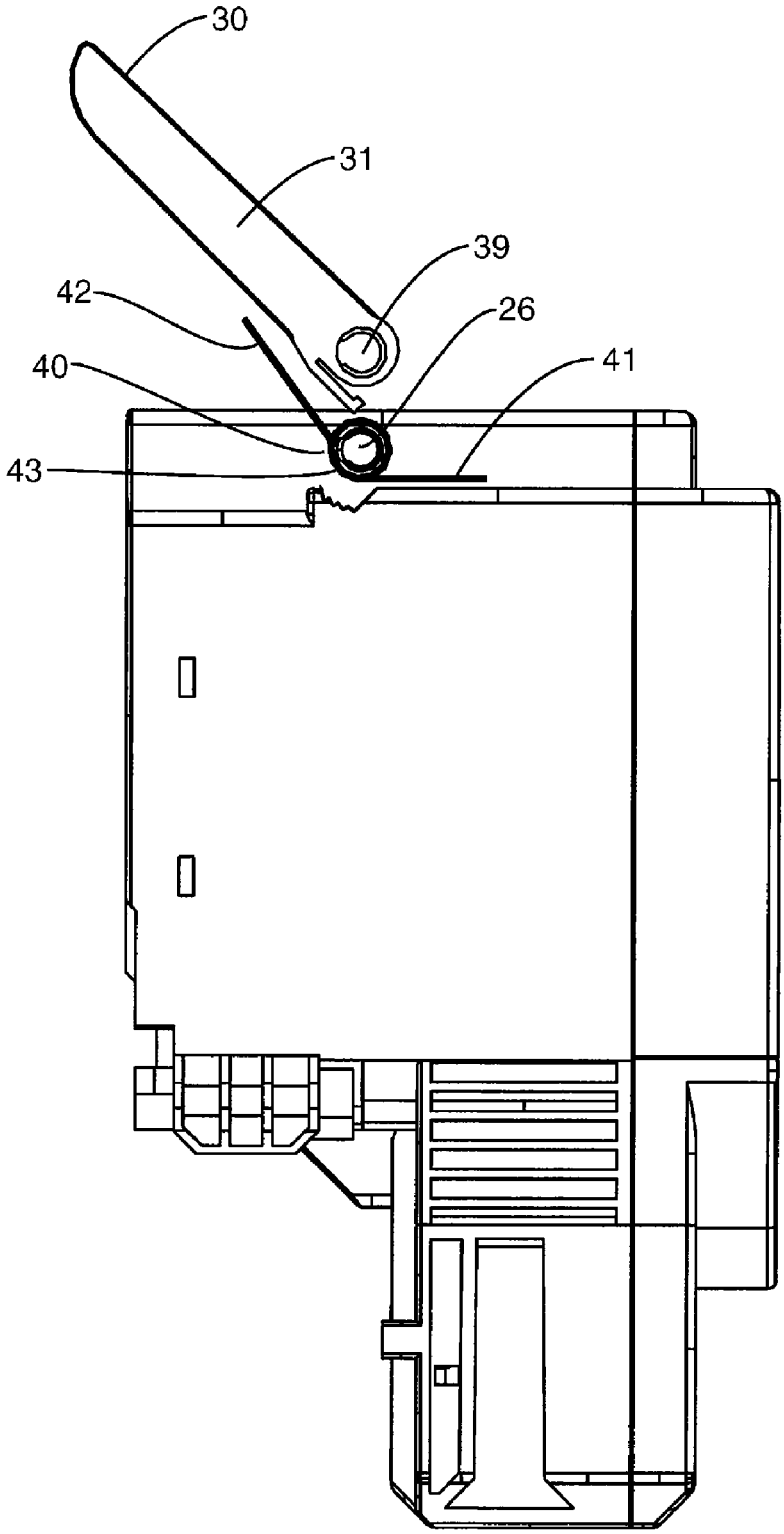
FIG. 10 is a partial exploded view of a handle removed from a cartridge body and a biasing member according to one embodiment.

One or more biasing members 40 force the handle 30 towards the open orientation. FIGS. 1A and 10 illustrate one embodiment of the biasing member 40 comprising a spring with a first section 41, second section 42, and an intermediate section 43. Biasing member 40 is positioned with the first section 41 positioned against the body 20 with the second section 42 extending outward above the upper side 21 of the body 20 and in contact with the arm 31 of the handle 30. FIG. 8 illustrates another embodiment with the biasing member 40 comprising a compressible material positioned between the handle 30 and the body 20. Movement of the handle 30 towards the closed orientation compresses the material and forces the handle 30 towards the open orientation.

Cartridge 10 may include one or more biasing members 40. In one embodiment, a first biasing member 40 is positioned on a first part of the body 20 to contact against a first arm 31 and a second biasing member 40 is positioned on a second part of the body 20 to contact against a second arm 31. In another embodiment, a single biasing member 40 contacts against the handle 30. In another embodiment, two or more biasing members 40 are positioned to contact a single arm 31.

Figure 11:
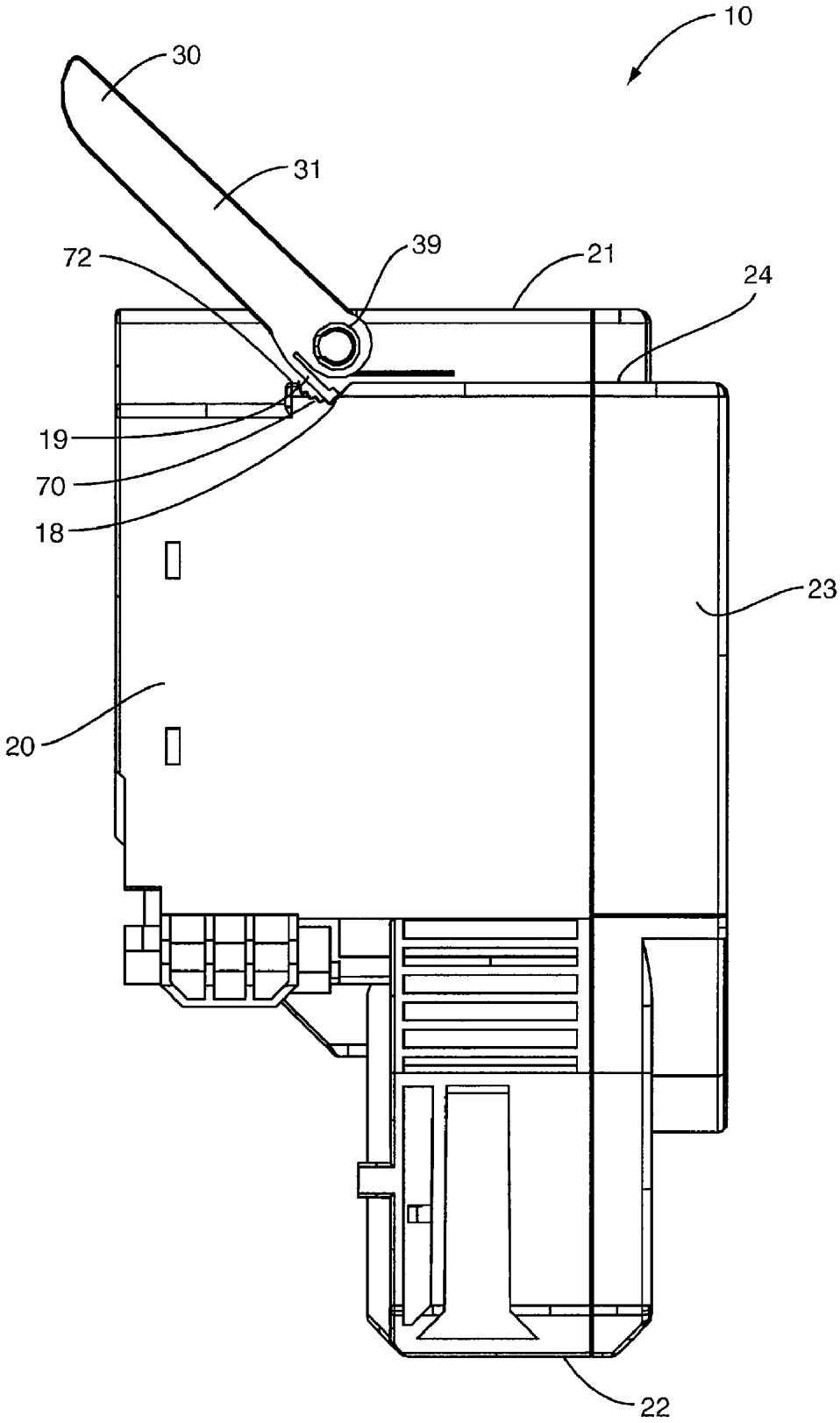
FIG. 11 is a side view of a handle being mounted to a cartridge according to one embodiment.
Figure 12:
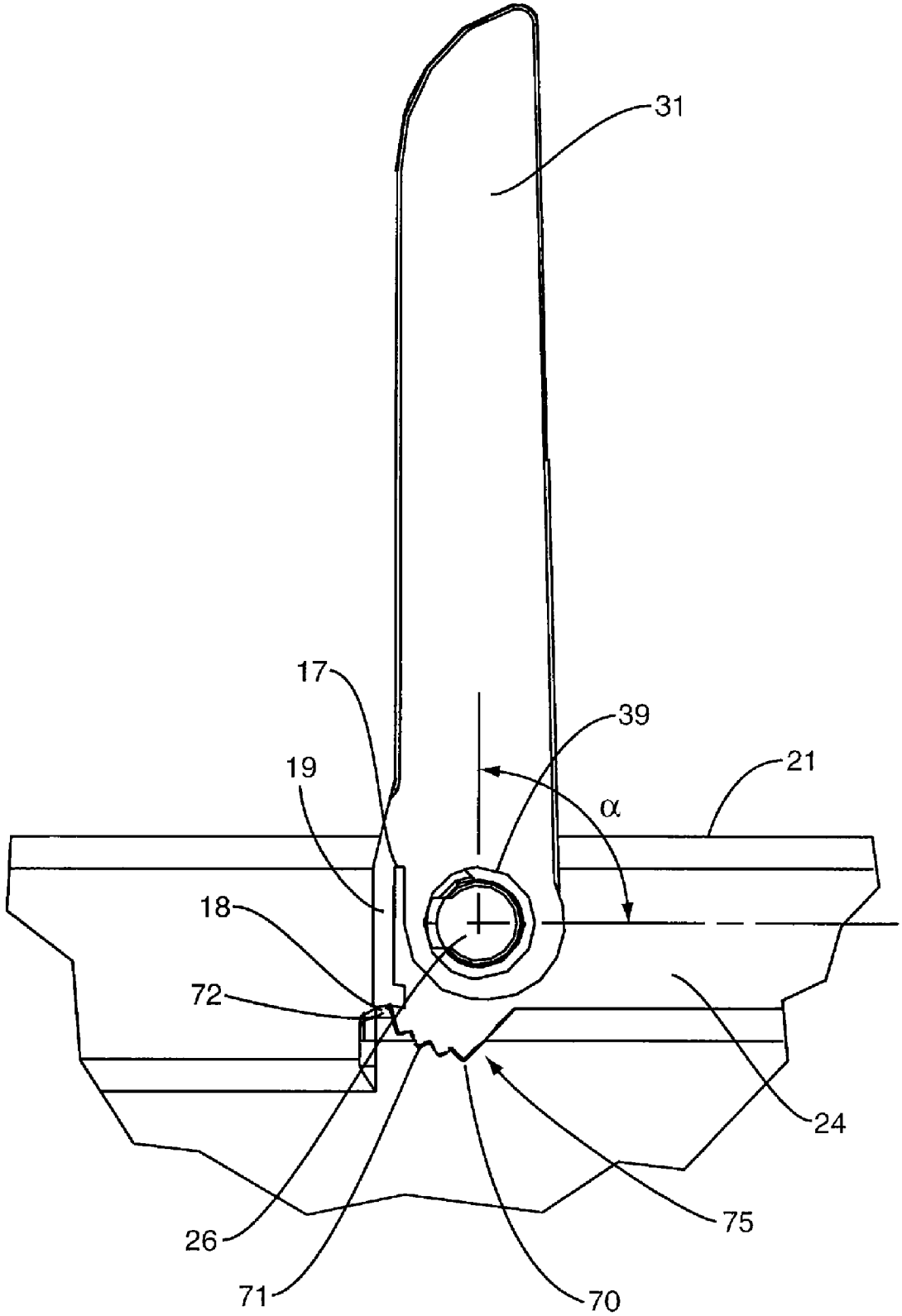
FIG. 12 is a side view of a handle in an open orientation according to one embodiment.

As illustrated in FIGS. 11 and 12, a leg 19 may be positioned on one or more of the arms 31. Leg 19 extends outward beyond a main section of the arm 31. A gap 17 may be positioned between the leg 19 and the main section to provide for the leg 19 to be flexible. A contact surface 18 is positioned at an end of the leg 19. Body 20 includes a keying feature 75 comprising an indent 70 with a series of steps 71, and a tab 72 positioned at the end of the steps 71.

The range of motion in the open orientation is limited by the contact surface 18 of the leg 19 contacting against the tab 72 as best seen in FIG. 12. This contact prevents the handle 30 from pivoting farther away from the indentation 24. The shape of the tab 72 and contact surface 18 provide for sliding contact when the handle 30 moves from the open orientation towards the closed orientation. An angle α is formed between the handle 30 and the body 20. In one embodiment, handle 30 operates within a range of about 90 degrees with the handle 30 being substantially aligned with the body in the closed orientation (i.e., α being about 0 degrees) and the handle 30 being substantially perpendicular to the body in an open orientation (i.e., α being about 90 degrees).

The keying featuring 75 also provides for attaching the handle 30 to the body 20 during manufacturing. Installation requires that the handle 30 be positioned outside of the operating range. In one example, the installation position is greater than about 90 degrees when the handle 30 operates within an α range of between about 0 degrees and 90 degrees. In one embodiment as illustrated in FIGS. 10 and 11, handle 30 is positioned to correspond to the un-deformed shape of the biasing member 40 and aligned with second section 42. While the handle 30 is in this initial position, the aperture 39 in the handle 30 is mounted over the projection 29 in the body 20. Once attached, handle 30 is pivoted towards the indentation (i.e., α is reduced). The leg 19 contacts against the steps 71 during the pivoting movement. Eventually, handle 30 is positioned at the open orientation with the contact surface 18 abutting against the tab 72 and the handle 30 fully attached to the body 20.

Figure 13:
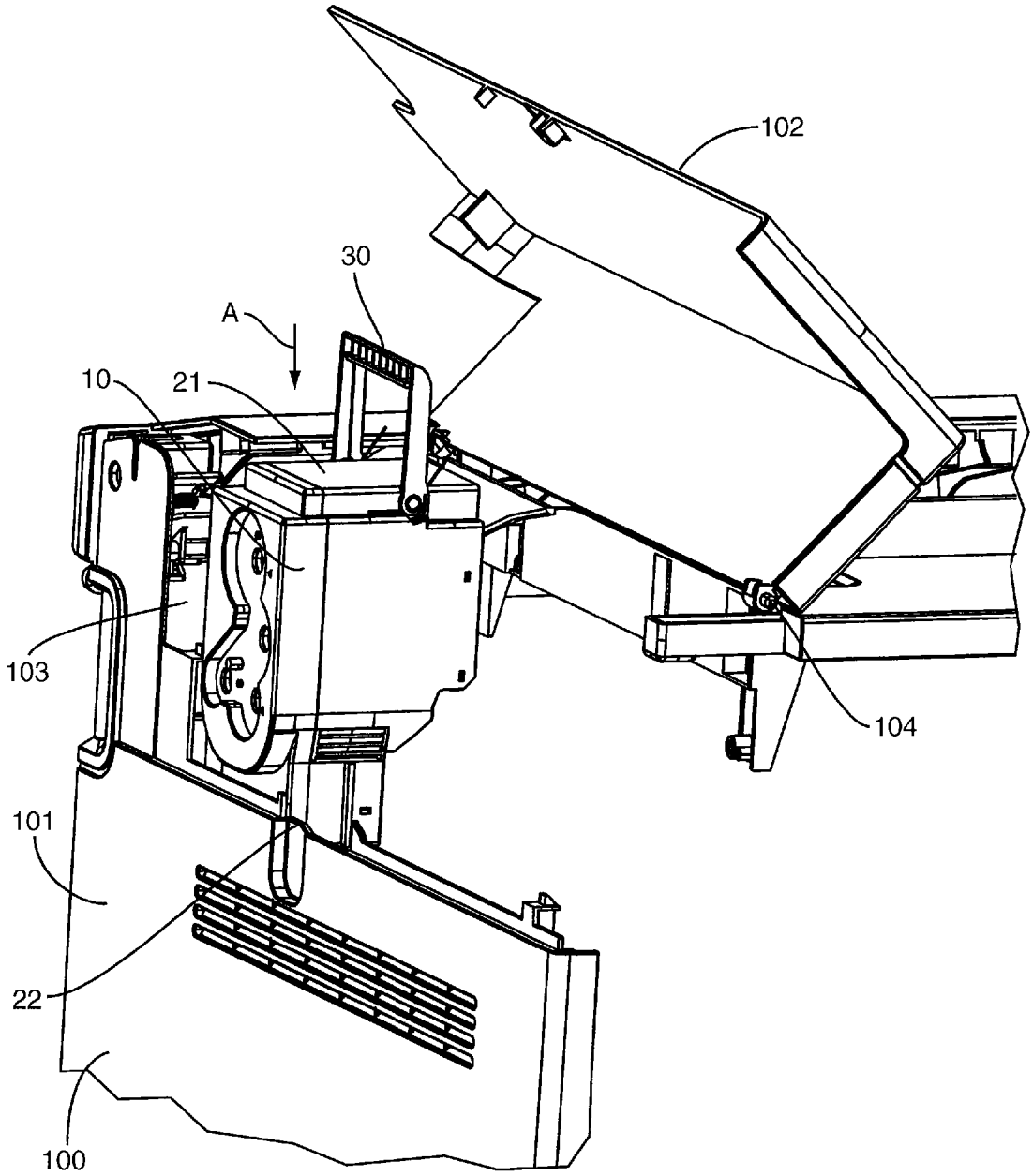
FIG. 13 is a partial perspective view of a cartridge being positioned into an image forming device according to one embodiment.

Handle 20 facilitates insertion and removal of the cartridge 10 from the image forming device 100. Handle 20 is in the open orientation when the cartridge 10 is removed from the image forming device 100 to provide a means for a user to grasp and manipulate the cartridge 10. FIG. 13 illustrates the cartridge 10 being installed into the image forming device 100. In this embodiment, image forming device 100 includes a body 101 with a receptacle 103 sized to receive the cartridge 10. A lid 102 is attached to the body 101 and pivotable about a hinge 104. Lid 102 is movable about the hinge 104 between an open orientation as illustrated in FIG. 13 and a closed orientation as illustrated in FIG. 14.

Installation of the cartridge 10 into the image forming device 100 requires the lid 102 be in the open orientation. The cartridge 10 is inserted into the body 101 in an insertion direction illustrated by arrow A in FIG. 13. This direction provides the user to grasp and manipulate the handle 30 that is in the open orientation and extended above the body 20. Insertion in direction A positions the bottom side 22 downward such that the electrical connector 60 can engage with the corresponding receptacle 110 in the image forming device 100. Further, the outlet 27 is aligned with an inlet in the image forming device 100 to receive the toner from the reservoir 29 as part of the image formation process. The initial engagement of the electrical connector 60 and outlet 27 may occur due to the insertion force applied by the user.

Figure 14:
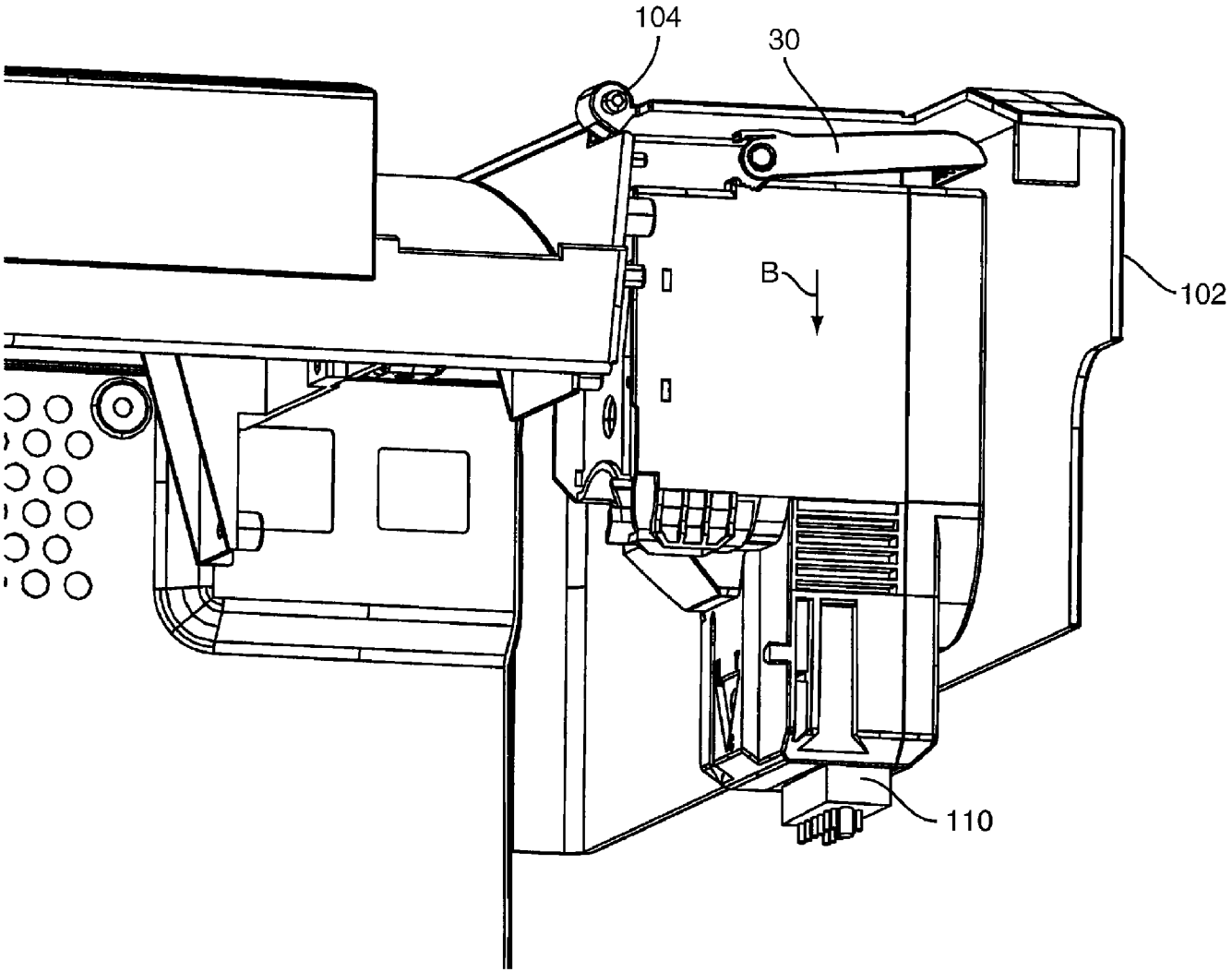
FIG. 14 is a partial perspective view of a cartridge mounted within an image forming device according to one embodiment.

Once the cartridge 10 is mounted within the body 101, lid 102 is moved to the closed orientation as illustrated in FIG. 14. Lid 102 moves about the hinge 104 and contacts the handle 30 when moving to the closed orientation. This contact provides for the movement of the lid 102 to move the handle 30 to the closed orientation. In one embodiment, the handle 30 contacts the top side 21 of the body 20 in the closed orientation. In another embodiment, handle 30 is spaced from the top side 21 in the closed orientation. As illustrated in FIG. 14, the force of the closing lid 102 overcomes the force of the one or more biasing members 40. The contact between the closed lid 102 and handle 30 causes the one or more biasing members 40 to exert an engagement force B. Engagement force B maintains the cartridge 10 engaged within the image forming device 100 with the electrical connector 60 maintaining contact with the receptacle 110. Engagement force B may also position the cartridge 10 such that the outlet 27 maintains position to transfer the toner from the reservoir.

In one embodiment as illustrated in FIG. 9B, handle 30 pivots about an axis line X. When the cartridge 10 is mounted within the body 101, axis line X is aligned to be substantially parallel with a pivot axis of the hinge 104.

Cartridge 10 may be used in a variety of image forming devices. The embodiments described above include laser image forming devices including but not limited to printers, facsimile machines, copiers, and combinations. One embodiment of an image forming device is disclosed in U.S. patent application Ser. No. 11/407,307 filed on Apr. 19, 2006 and entitled "Architecture for an Image Forming Device" which is herein incorporated by reference. In another embodiment, the cartridge 10 is constructed to contain ink that is usable in an ink jet printing device.

Figure 15:
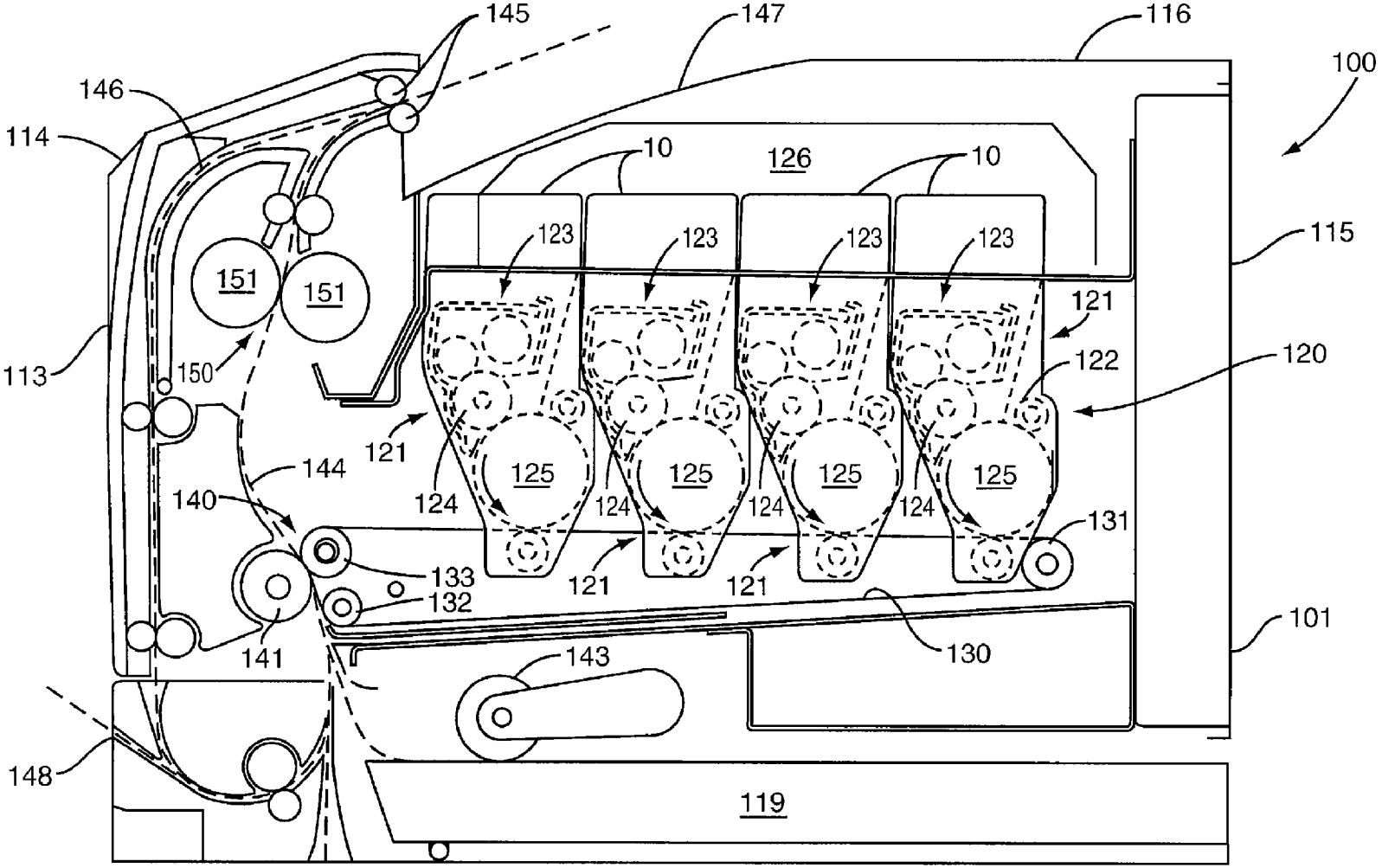
FIG. 15 is a side schematic view of an image forming device according to one embodiment.

FIG. 15 illustrates one embodiment of an image forming device 100. The device 100 includes a media input tray 119 positioned in a lower section of the body 101. The tray 119 is sized to contain a stack of media sheets that will receive color and/or monochrome images. The media input tray 119 is preferably removable for refilling. A control panel 114 may be located on the front 113 of the body 112. Using the control panel 114, the user is able to enter commands and generally control the operation of the image-forming device 100. For example, the user may enter commands to switch modes (e.g., color mode, monochrome mode), view the number of images printed, take the device 100 on/off line to perform periodic maintenance, and the like.

A first toner transfer area 120 includes one or more imaging units 121 that are aligned horizontally extending from the front 113 to a back 115 of the body 101. Each imaging unit 121 includes a charging roll 122, a developer 123 that includes various paddles and rollers for stirring and moving toner and a developer roll 124, and a rotating photoconductive (PC) drum 125. The charging roll 122 forms a nip with the PC drum 125, and charges the surface of the PC drum 25 to a specified voltage such as −1000 volts, for example. A laser beam from a printhead 126 contacts the surface of the PC drum 125 and discharges those areas it contacts to form a latent image. In one embodiment, areas on the PC drum 125 illuminated by the laser beam are discharged to approximately −300 volts. The developer roll 124, which also forms a nip with the PC drum 125, then transfers toner from the cartridge 10 containing a supply of toner to the PC drum 125, to form a toner image. The toner is attracted to the areas of the PC drum 125 surface discharged by the laser beam from the printhead 126.

The cartridges 10 may be operatively connected to each of the imaging units 121 in toner transfer relationship, when the toner cartridges 10 are inserted into the imaging forming device 100. The toner cartridges 10 may be mounted and removed from the device 100 independently from the imaging units 121. In one embodiment, the toner cartridges 10 each contain one of black, magenta, cyan, or yellow toner. Each of toner cartridges 10 may be substantially the same, or one or more of the toner cartridges 10 may hold different toner capacities. In one specific embodiment, the black toner cartridge 10 has a higher capacity than the others. The toner cartridges 10 may mount from a top 116 of the device 100, in a generally vertical direction, and may detach during removal with the imaging units 121 remaining within the device 100.

An intermediate transfer mechanism (ITM) 130 is disposed adjacent to each of the imaging units 121. In this embodiment, the ITM 130 is formed as an endless belt trained about support roller 131, tension roller 132 and back-up roller 133. During image forming operations, the ITM 130 moves past the imaging units 121 in a clockwise direction as viewed in FIG. 15. One or more of the PC drums 125 apply toner images in their respective colors to the ITM 130. In one embodiment, a positive voltage field attracts the toner image from the PC drums 125 to the surface of the moving ITM 130.

The ITM 130 rotates and collects the one or more toner images from the imaging units 121 and then conveys the toner images to a media sheet at a second transfer area. The second transfer area includes a second transfer nip 140 formed between the back-up roller 133 and a second transfer roller 141.

A media path 144 extends through the device 100 for moving the media sheets through the imaging process. Media sheets are initially stored in the input tray 119 or introduced into the body 101 through a manual feed 148. The sheets in the input tray 119 are picked by a pick mechanism 143 and moved into the media path 144. In this embodiment, the pick mechanism 143 includes a roller positioned at the end of a pivoting arm. The roller rotates to move the media sheets from input tray 119 towards the second transfer area. In one embodiment, the pick mechanism 143 is positioned in proximity (i.e., less than a length of a media sheet) to the second transfer area with the pick mechanism 143 moving the media sheets directly from the input tray 119 into the second transfer nip 140. For sheets entering through the manual feed 148, one or more rollers are positioned to move the sheet into the second transfer nip 140.

The media sheet receives the toner image from the ITM 130 as it moves through the second transfer nip 140. The media sheets with toner images are then moved along the media path 144 and into a fuser area 150. Fuser area 150 includes fusing rollers or belts 151 that form a nip to adhere the toner image to the media sheet. The fused media sheets then pass through exit rollers 145 that are located downstream from the fuser area 150. Exit rollers 145 may be rotated in either forward or reverse directions. In a forward direction, the exit rollers 145 move the media sheet from the media path 144 to an output area 147. In a reverse direction, the exit rollers 145 move the media sheet into a duplex path 146 for image formation on a second side of the media sheet.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A toner cartridge for use in an image forming device comprising:

a body with an enclosed interior to contain toner;

an electrical connector including electrical contacts positioned on a first side of the body;

a handle mounted to a second side of the body opposite from the first side, the handle being movable between an open orientation that extends outward from the body and a closed orientation positioned in proximity to the body; and a biasing member operatively connected to the handle to bias the handle towards the open orientation.

2. The toner cartridge of claim 1, wherein the body includes an indent and the handle includes a leg that extends into the indent.

3. The toner cartridge of claim 2, wherein the indent includes a plurality of steps sized to contact against the leg.

4. A toner cartridge for use in an image forming device comprising:

a body with an enclosed interior to contain toner;

an electrical connector attached to the body and including electrical contacts;

a handle mounted to the body and movable between a first orientation that extends outward from the body and a second orientation positioned in closer proximity to the body, the handle configured to receive a force from a closure member of the image forming device when positioned in the second orientation; and a biasing member operatively connected to the handle to bias the handle toward the first orientation, the biasing member arranged to transfer the force from the handle to the body and the electrical connector when the handle is positioned in the second orientation to maintain the electrical connector operatively connected to the image forming device.

5. The toner cartridge of claim 4, wherein the handle is mounted on a top of the body and the electrical connector is mounted on a bottom of the body.

6. The toner cartridge of claim 4, wherein the body further comprises a cavity sized to contain the electrical connector.

7. The toner cartridge of claim 4, wherein the handle includes an aperture to receive a projection that extends outward from the body, the handle further includes a leg that extends outward from the handle in proximity to the aperture.

8. A toner cartridge for use in an image forming device comprising:

a body with an enclosed interior to contain toner, the body includes a first side and a second side opposite from the first side;

an electrical connector including electrical contacts positioned on the first side of the body;

a handle movable mounted to the second side of the body and being movable between a first orientation that extends outward from the second side and a second orientation positioned in proximity to the second side; and a biasing member operatively connected to the handle to bias the handle towards the first orientation.

9. The toner cartridge of claim 8, further comprising a cavity formed on the first side of the body, the electrical connector positioned within the cavity.

10. The toner cartridge of claim 8, further comprising a scalloped section on the second side of the body that includes a series of steps to contact a leg on the handle during assembly of the toner cartridge.

* * * * *